US005982206A

United States Patent [19]

Tachio et al.

[11] Patent Number: 5,982,206

[45] Date of Patent: Nov. 9, 1999

[54] TRANSCURRENT CIRCUIT AND CURRENT-VOLTAGE TRANSFORMING CIRCUIT USING THE TRANSCURRENT CIRCUIT

[75] Inventors: Yuasa Tachio; Osamu Kobayashi, both of Kawasaki, Japan

[73] Assignee: Fujitsu Limited, Kawasaki, Japan

[21] Appl. No.: 08/842,534

[22] Filed: Apr. 15, 1997

[30] Foreign Application Priority Data

May 17, 1996 [JP] Japan ..... 8-123657

[51] Int. Cl.[6] ..... H02M 11/00

[52] U.S. Cl. ..... 327/103; 327/427; 323/315

[58] Field of Search ..... 327/103, 334, 327/100, 427; 323/315, 317

[56] References Cited

U.S. PATENT DOCUMENTS

| | | | |
|---|---|---|---|
| 4,453,094 | 6/1984 | Peil et al. | 323/315 |
| 4,550,284 | 10/1985 | Sooch | 323/315 |
| 4,608,530 | 8/1986 | Barcrania | 323/315 |
| 4,723,108 | 2/1988 | Murphy et al. | 323/315 |
| 5,311,115 | 5/1994 | Archer | 323/315 |
| 5,353,028 | 10/1994 | De Wit et al. | 323/315 |
| 5,589,800 | 12/1996 | Peterson | 323/315 |

*Primary Examiner*—Toan Tran

*Attorney, Agent, or Firm*—Armstrong, Westerman, Hattori, McLeland & Naughton

[57] ABSTRACT

A transcurrent circuit in which a first current flows in an output-stage circuit based on a second current flowing in an input-stage circuit and a given current transform ratio of the first current to the second current. In the transcurrent circuit, at least one of the input-stage circuit and the output-stage circuit in the transcurrent circuit is constructed with a plurality of transistors. Further, all the transistors in both of the input-stage circuit and the output-stage circuit have the same gate length.

15 Claims, 10 Drawing Sheets

TRANSCURRENT CIRCUIT AND CURRENT-VOLTAGE TRANSFORMING CIRCUIT USING THE TRANSCURRENT CIRCUIT

BACKGROUND OF THE INVENTION

1. Field of the Invention

The present invention generally relates to a transcurrent circuit, and more particularly, to a transcurrent circuit forming a part of an electronic circuit generally used in electronic devices.

2. Description of the Related Art

Recently, in integrated circuits (ICs) used for miniaturization and power reduction of electronic devices, particularly, an integrated circuit (IC) manufactured in a process using a Metal Oxide Semiconductor Field Effect Transistor (MOSFET) is widely used. Further, in these electronic circuits constructed with transistors, a transcurrent circuit and a current mirror circuit, which produce a current output determined by a specified transient function from a current input, are known.

When manufacturing the integrated circuit, it is difficult to form each device element at precise absolute characteristic values, but it is significantly easy to precisely determine a relative value between the characteristics of the device elements. Using the above-discussed feature of the integrated circuit, in a transcurrent circuit such as a current mirror circuit, miniaturization of the circuit forming area and reduction of the circuit power consumption are required.

FIG. 1 shows a schematic diagram of a prior art transcurrent circuit. In FIG. 1, a basic circuit of a transcurrent circuit 11 is shown. In the transcurrent circuit 11, a drain of a transistor M1 (for example, an N-channel MOSFET) is connected to a first power source 12, and a source thereof is connected to an earth ground (GND) as a second power source. Further, a gate of the transistor M1 is connected to the drain of itself. The transistor M1 is specified by a ratio of a gate width $W_1$ to a gate length $L_1$ ($W_1/L_1$).

On the other hand, a drain of a transistor M2 of an N-channel MOSFET is connected to a third power source 13, and a source thereof is connected to the GND. Further, a gate of the transistor M2 is connected to the gate of the transistor M1. The transistor M2 is specified by a ratio of a gate width $W_2$ to a gate length $L_2$ ($W_2/L_2$).

In this case, the gate width $W_2$ of the transistor M2 is designed to be the same as the gate width $W_1$ of the transistor M1, and the gate length $L_2$ is designed to be the same as n times the gate length $L_1$ of the transistor M1. Therefore, the ratio ($W_2/L_2$) in the transistor M2 is represented by a ratio ($W_1/nL_1$).

In the transcurrent circuit 11, when a drain current $I_1$ flows into the transistor M1 on an input stage, a voltage is applied to the drain of the transistor M2 on an output stage, and a current $I_2$ as an output current flows through the transistor M2.

FIG. 2A shows a top plane view of a layout pattern of the transistor M1 in the integrated circuit shown in FIG. 1, and FIG. 2B shows a top plane view of a layout pattern of the transistor M2 in the integrated circuit. At the transistor M1 and the transistor M2 shown in FIG. 2A and FIG. 2B, a drain (D) region, a gate (G) region, and a source (S) region are formed on the wafer at a given distance interval.

As discussed above, the gate length and the gate width of the transistor M1 are respectively designed to be $L_1$ and $W_1$. For the transistor M2, the gate length and the gate width thereof are designed to be $L_2$ (=$nL_1$) and $W_2$ (=$W_1$). For the transistors M1, M2, a ratio of current transform ($I_2/I_1$) is changed by the gate length and the gate width.

Namely, a current transform ratio R1 (=$I_2/I_1$) in the transcurrent circuit 11 is represented by the following equation.

$$R1 = (\text{gate width of the transistor } M2 / \text{gate length of the transistor } M2) \times (\text{gate length of the transistor } M1 / \text{gate width of the transistor } M1) \quad (1)$$

The above equation is represented using each gate length and each gate width as follows:

$$R1=(W_1/nL_1)\times(L_1/W_1)=1/n$$

For example, for achieving a current ratio $I_1$:$I_2$=1:2, the gate widths of the transistors M1, M2 are set to be the same and the gate length of the transistor M1 is set to be $2L_1$ (namely, n=2).

Since the circuit forming area of the transcurrent circuit needs to be reduced, the gate lengths of the transistors M1, M2 are designed as small as possible, for example, to be less than 1 $\mu$m, which is substantially the minimum value with present manufacturing techniques.

FIG. 3 shows a schematic diagram of a current-voltage transforming circuit using the prior art transcurrent circuit. A current-voltage transforming circuit 21 shown in FIG. 3 is constructed with a transcurrent circuit 22 and a voltage transforming circuit 23.

In the transcurrent circuit 22, a source (S) of a transistor M3 of a P-channel MOSFET is connected to a first power source 24, and a drain (D) thereof is connected to an earth ground (GND) as a second power source through a current source 25.

Further, a source (S) of a transistor M4 of a P-channel MOSFET is connected to the first power source 24, and a drain (D) thereof is connected to the earth ground (GND) as the second power source through a current source 26. In addition, gates (G) of the respective transistors M3, M4 are connected to each other, and the gates (G) is also connected to the drain (D) of the transistor M3.

On the other hand, in the voltage transforming circuit 23, a source (S) of a transistor M5 of a P-channel MOSFET is connected to the first power source 24, and a drain (D) thereof is connected to the earth ground (GND) as the second power source through a current source 27. Further, a gate of the transistor M5 is connected to the drain (D) of the transistor M4. Also, from a drain (D) of the transistor M5, an output voltage $V_0$ is produced.

In this case, the transistors M3 and M4 have the same gate width $W_1$ and gate length $nL_1$, and the transistor M5 has the gate width $W_1$ and the gate length $L_1$. Therefore, currents $I_3$ and $I_4$ flowing through the current sources 25 and 26 are set to be the same ($I_3$=$I_4$).

In this configuration, when the current $I_3$ (and $I_4$) flowing from the current sources 25, 26 into the transistors M3, M4 is flexibly changed a little, a drain voltage of the transistor M4 also varies. When the variation of the drain voltage of the transistor M4 is applied to the gate of the transistor M5, a voltage amplitude $V_0$ is obtained from the drain (D) of the transistor M5.

In this case, when each voltage at the connection nodes comes close to the voltage of each power source, the voltage amplitude $V_0$ may decrease. Therefore, in order to prevent the voltage amplitude $V_0$ from decreasing, a ratio of current values flowing the current paths needs to be maintained.

Namely, so as to maintain the following relationship (2), the gate widths and the gate lengths of the respective transistors M3 to M5 need to be designed.

$$\text{(gate width of the transistor } M3\text{/gate length of the transistor } M3\text{):(gate width of the transistor } M5\text{/gate length of the transistor } M5) = I_3 : I_5 \quad (2)$$

FIG. 4A and FIG. 4B show illustrations for explaining a principle of voltage transformation in the current-voltage transforming circuit 21 shown in FIG. 3. FIG. 4A shows a conventional amplifier circuit using a MOSFET M0. In FIG. 4A, a resistor R is connected to a drain of the transistor M0. When an input voltage $V_{in}$ is applied to a gate of the transistor M0, a drain current $I_D$ is represented by an equation $I_D=g_m V_{in}$ ($g_m$ is conductance of the transistor M0, and the drain current $I_D$ is obtained as a voltage through the resistor R.

In this case, since an output voltage $V_{out}$ is determined by an equation $V_{out}=I_D \times R=g_m \times V_{in} \times R$, an amplifying ratio (amplifier gain) is represented by $V_{out}/V_{in}=g_m \times R$. In the integrated circuit, a value of the resistor R may not be increased enough, because a large forming area is required for the resistor. Therefore, in the circuit shown in FIG. 4A, the amplifying ratio cannot be obtained much.

In the circuit shown in FIG. 4B, a current source 28 constructed with a transistor is provided instead of the resistor R as compared to the circuit shown in FIG. 4A. Using an internal resistor $R_{ds}$ of the current source 28, in the same way as shown in FIG. 4A, the output voltage $V_{out}$ is produced. In this case, the amplifying ratio is represented by $V_{out}/V_{in}=g_m \times R_{ds}$. As discussed above, the current source 28 is constructed with the transistor. Therefore, the internal resistor $R_{ds}$ may be formed as a relatively large value, and, thus, the amplifying ratio may be increased.

Returning to FIG. 3, when the current flowing from the current sources 25, 26 is slightly changed, the gate voltage $V_{GS}$ of the transistor M5 changes, and the drain current flows from the transistor M5. When an internal resistor of the current source 27 is formed as a large value, the amplifying ratio of the voltage transforming circuit 23 may be increased. As a result, a large variation of the output voltage $V_0$ may be obtained.

However, in the above-discussed transcurrent circuit 11 shown in FIG. 1 and current-voltage transforming circuit 21 shown in FIG. 3, when the gate lengths of the transistors M1 to M5 of the MOSFETs vary, a threshold voltage also changes due to the short channel effect. As a result, the above-discussed equations (1) and (2) may not be defined.

In general, when the layout patterns are formed on the wafer, dispersion of the gate length and the gate width occurs due to imperfect mechanical precision. When a deviation of the gate length due to the dispersion is represented by a symbol "δ", the current transform ratio in the transcurrent circuit 11 shown in FIG. 1 is shown in the following equation (3).

$$\left(\begin{array}{c}\text{gate length of}\\ \text{the transistor } M1\end{array}\right) \Big/ \left(\begin{array}{c}\text{gate length of}\\ \text{the transistor } M2\end{array}\right) = (L_1+\delta)/(nL_1+\delta) \neq (1/n) \quad (3)$$

Further, the current transform ratio in the current-voltage transforming circuit 21 shown in FIG. 3 is shown in the following equation (4).

$$\left(\begin{array}{c}\text{gate length of}\\ \text{the transistor } M3\end{array}\right) \Big/ \left(\begin{array}{c}\text{gate length of}\\ \text{the transistor } M5\end{array}\right) = (nL_1+\delta)/(L_1+\delta) \neq n \quad (4)$$

Therefore, there is a problem in that it is very difficult to achieve a desired current transform ratio due to dispersion of the gate length which occurred in the pattern forming process.

Further, in order to reduce an influence from the dispersion of the gate length which occurs in the pattern forming process, some methods can be used for obtaining a large current transform ratio. For example, a first method is to increase the gate length, and a second method is changing the gate width while maintaining the gate length at the same value. However, the methods of increasing the gate length or the gate width cause the gate region to increase. Therefore, there is a problem in that methods as reducing of the circuit forming area may not be achieved.

SUMMARY OF THE INVENTION

It is an object of the present invention to provide a transcurrent circuit and a current-voltage transforming circuit using the transcurrent circuit. In the transcurrent circuit and the current-voltage transforming circuit, a desired current transform ratio may be easily obtained. Further, a circuit forming area may be reduced. In addition, since flexibility of setting a current value is increased, power consumption of the circuit can be reduced. This permits the disadvantages described above to be eliminated.

The object described above is achieved by a transcurrent circuit in which a first current flows an output-stage circuit based on a second current flowing an input-stage circuit and a given current transform ratio of the first current to the second current, wherein: at least one of the input-stage circuit and the output-stage circuit in the transcurrent circuit is constructed with a plurality of transistors; and all the transistors in the input-stage circuit and the output-stage circuit have the same gate length.

The object described above is also achieved by the transcurrent circuit mentioned above, wherein the number of the plurality of transistors is determined by the current transform ratio.

According to the above-discussed transcurrent circuit, the number of transistors in at least one of the input-stage circuit and the output-stage circuit is set by the given current transform ratio, and all the transistors in the input-stage circuit and the output-stage circuit have the same gate length.

Therefore, even if dispersion of the gate length occurs in a transistor forming process, influence on the current transform ratio from the dispersion of the gate length may be prevented, and, thus, a desired current transform ratio may be precisely obtained. Accordingly, a gate forming area may be reduced, and, thus, a circuit forming area may be miniaturized. Further, since flexibility of designing a current value is improved, reduction of circuit power consumption may be achieved.

The object described above is also achieved by the transcurrent circuit mentioned above, wherein all the transistors in the input-stage circuit have the same gate width.

The object described above is also achieved by the transcurrent circuit mentioned above, wherein all the transistors in the output-stage circuit have the same gate width.

The object described above is also achieved by the transcurrent circuit mentioned above, wherein all the transistors in the input-stage circuit and the output-stage circuit have the same gate width.

The object described above is also achieved by the transcurrent circuit mentioned above, wherein the gate width of the transistor in the input-stage circuit is set so as to be different from the gate width of the transistor in the output-stage circuit according to the current transform ratio.

The object described above is also achieved by the transcurrent circuit mentioned above, wherein the gate width of the transistor in the output-stage circuit is set so as to be different from the gate width of the transistor in the input-stage circuit according to the current transform ratio.

According to the above-discussed transcurrent circuit, the transistors in each of the input-stage circuit and the output-stage circuit have the same gate width, the transistors in both the input-stage circuit and the output-stage circuit have the same gate width, or the transistors in the input-stage circuit have a gate width different from the gate width of the transistors in the output-stage circuit.

Therefore, regardless of the gate length of the transistors, the gate width and the number of transistors (substantially corresponds to variation of the gate length) may be set, and, thus, a desired current transform ratio may be obtained. As a result, flexibility of designing the current value may be improved.

The object described above is also achieved by a current-voltage transforming circuit comprising: a transcurrent circuit in which a first current flows an output-stage circuit based on a second current flowing an input-stage circuit and a given current transform ratio of the first current to the second current, wherein at least one of the input-stage circuit and the output-stage circuit in the transcurrent circuit is constructed with a plurality of transistors, and all the transistors in the input-stage circuit and the output-stage circuit have the same gate length; and a voltage transforming circuit producing a voltage according to the first current flowing the output-stage circuit of the transcurrent circuit, the voltage transforming circuit being constructed with a given number of transistors having the same gate length as that of the transistors in the transcurrent circuit.

The object described above is also achieved by the current-voltage transforming circuit mentioned above, wherein all the transistors in the voltage transforming circuit have the same gate width.

According to the above-discussed current-voltage transforming circuit, the voltage transforming circuit is provided for producing the voltage according to the first current in the output-stage circuit of the transcurrent circuit. Further, all the transistors in the voltage transforming circuit have the same gate length, and the gate length of the transistors in the voltage transforming circuit is set to be the same gate length as that of all the transistors in the transcurrent circuit.

Therefore, flexibility of designing a transistor area according to the current transform ratio and a current value may be improved. Accordingly, the current of a current source may be reduced, and a circuit area for the current-voltage transforming circuit may also be reduced. As a result, miniaturization of the circuit and reduction of power consumed by the circuit may be achieved.

The object described above is also achieved by the current-voltage transforming circuit mentioned above, wherein all the transistors in the voltage transforming circuit have the same gate width as that of the transistors in at least one of the input-stage circuit and the output-stage circuit in the transcurrent circuit.

The object described above is also achieved by the current-voltage transforming circuit mentioned above, wherein all the transistors in the voltage transforming circuit have a gate width different from the gate width of the transistors in the input-stage circuit and the output-stage circuit of the transcurrent circuit.

According to the above-discussed current-voltage transforming circuit, the gate width of all the transistors in the voltage transforming circuit is equal to or different from the gate width of the transistors in the input-stage circuit and the output-stage circuit of the transcurrent circuit. Therefore, flexibility of setting the currents flowing the transcurrent circuit and the voltage transforming circuit may be improved. As a result, miniaturization of the circuit forming area and reduction of circuit power consumption may be achieved.

Other objects and further features of the present invention will be apparent from the following detailed description when read in conjunction with the accompanying drawings.

BRIEF DESCRIPTION OF THE DRAWINGS

FIG. 6A shows a case where a single MOSFET is provided, and FIG. 6B shows a case where a plurality of MOSFETs connected in series are provided;

FIG. 7A shows a prior art circuit example in which a plurality of transistors has the same gate length, and the current transform ratio is determined by the gate widths of the transistors. FIG. 7B shows a circuit example according to the present invention corresponding to the circuit shown in FIG. 5A;

DETAILED DESCRIPTION OF THE PREFERRED EMBODIMENTS

Figure 5A:
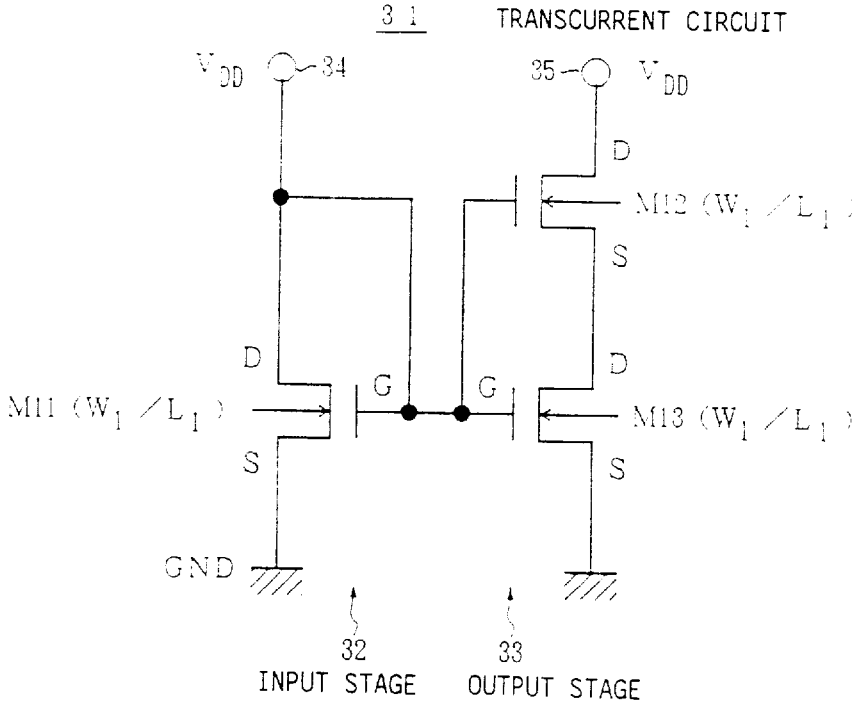
FIG. 5A shows a schematic diagram of a transcurrent circuit according to the present invention.
Figure 5B:
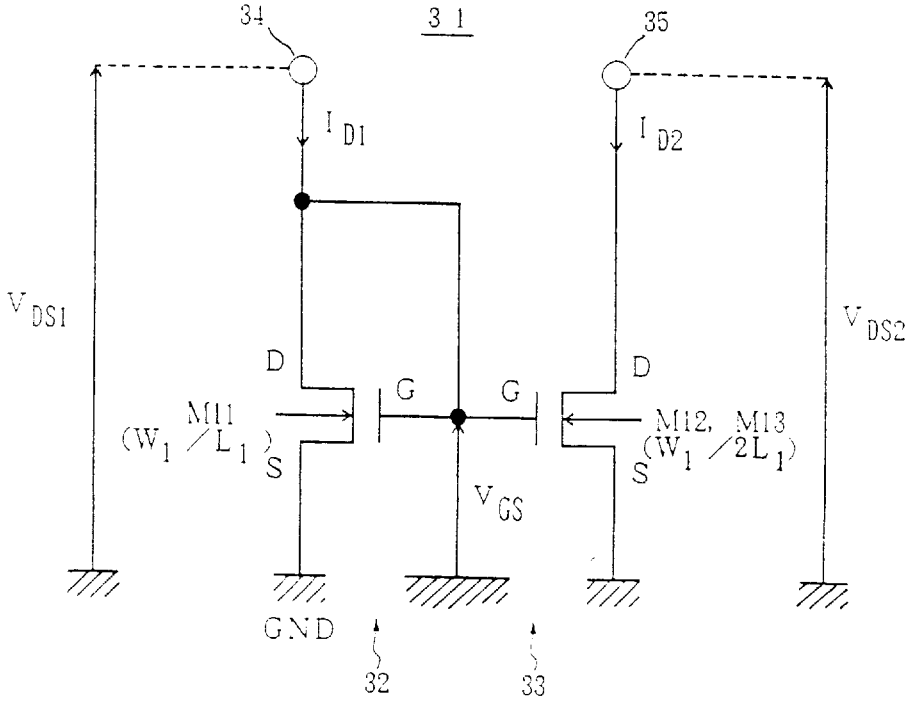
FIG. 5B shows an equivalent circuit of the transcurrent circuit shown in FIG. 5A.

A description will be given of a transcurrent circuit according to the present invention. FIG. 5A shows a schematic diagram of a transcurrent circuit 31 according to the present invention. FIG. 5B shows an equivalent circuit of the transcurrent circuit 31 shown in FIG. 5A.

The transcurrent circuit 31 shown in FIG. 5A is constructed with an input stage 32 and an output stage 33. In the input stage 32, a drain (D) of a transistor M11 of an N-channel MOSFET is connected to a first power source ($V_{DD}$) 34, and a source (S) thereof is connected to an earth ground (GND) as a second power source. Further, a gate (G) of the transistor M11 is connected to the drain (D) of the transistor.

On the other hand, in the output stage 33, a drain (D) of a transistor M12 of an N-channel MOSFET is connected to a third power source ($V_{DD}$) 35, and a source (S) thereof is connected to a drain (D) of a transistor M13 of an N-channel MOSFET. Further, a source (S) of the transistor M13 is connected to the earth ground (GND). In addition, respective gates of the transistors M12 and M13 are connected to each other in common, and are connected to the gate (G) of the transistor M11.

Figure 2A:
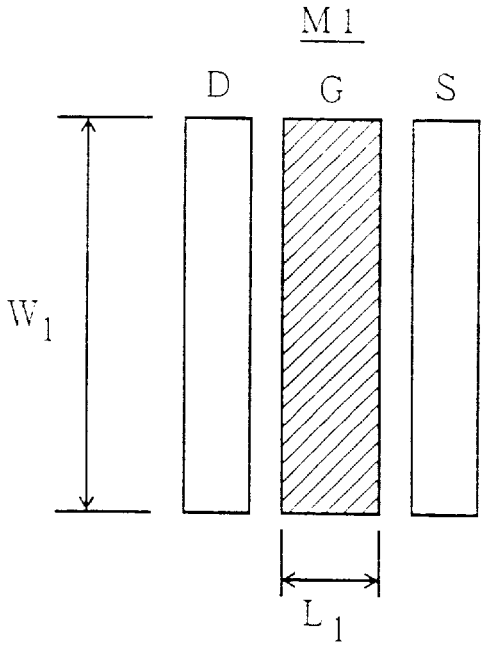
FIG. 2A PRIOR ART
FIG. 2A shows a top plane view of a layout pattern of the transistor M1 in an integrated circuit shown in FIG. 1.
Figure 2B:
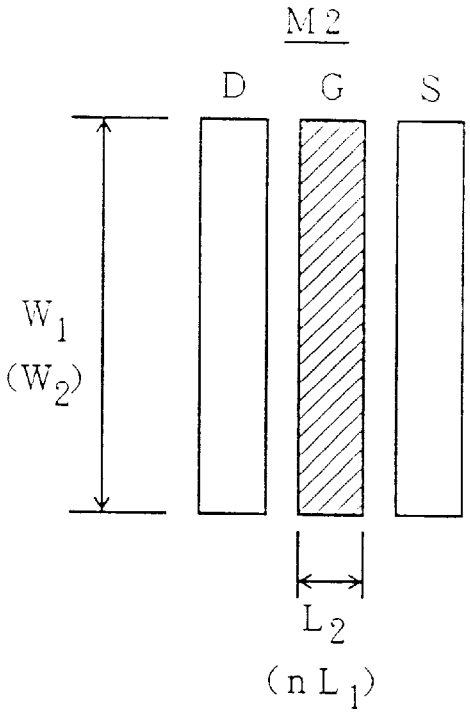
FIG. 2B PRIOR ART
FIG. 2B shows a top plane view of a layout pattern of the transistor M2 in the integrated circuit.
Figure 3:
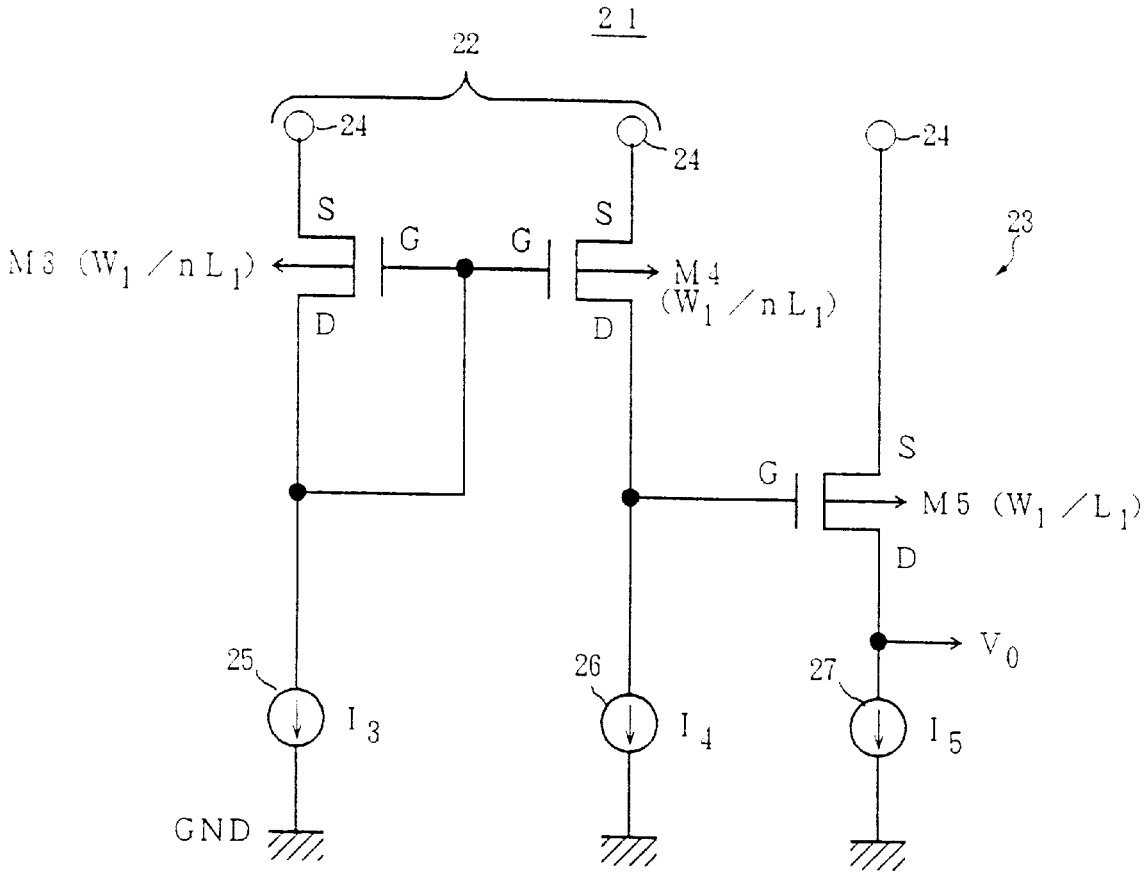
FIG. 3 PRIOR ART
FIG. 3 shows a schematic diagram of a current-voltage transforming circuit using the prior art transcurrent circuit.
Figure 4A:
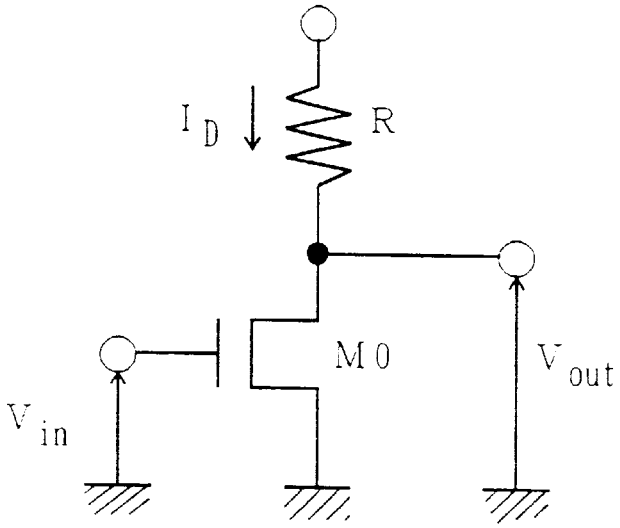
FIG. 4A PRIOR ART
FIG. 4A and FIG. 4B show illustrations for explaining a principle of voltage transformation in the current-voltage transforming circuit shown in FIG. 3.
Figure 4B:
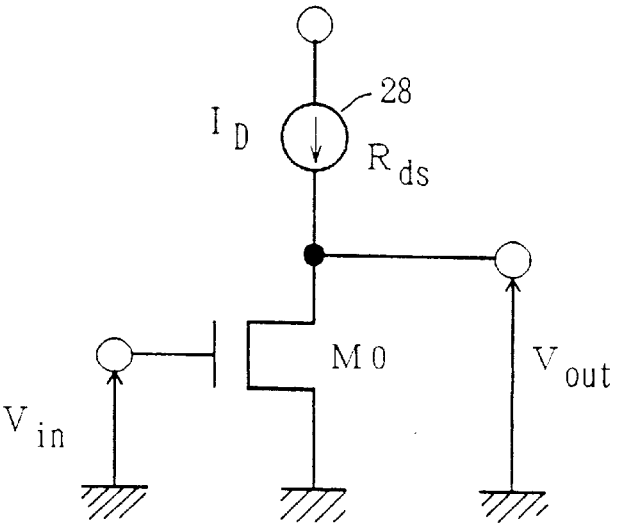
FIG. 4B PRIOR ART

In this case, each of the gates of the transistors M11 to M13 is formed by a gate width $W_1$ and a gate length $L_1$ in the same way as shown in FIG. 2A. At this time, as shown in FIG. 5B, the output stage 35 can be equivalently represented by a single transistor having a gate width $W_1$ and a gate length $2L_1$.

In this configuration, a current transform ratio R2 of the transcurrent circuit 31 is obtained from the equation (1) as follows:

$$\begin{aligned} R2 &= \{\text{gate width of the transistor } M12(M13)/(\text{gate length of the transistor } M12 + \text{gate length of the transistor } M13)\} \times (\text{gate length of the transistor } M11/\text{gate width of the transistor } M11) \\ &= \{W_1/(L_1+L_1)\} \times (L_1/W_1) = 1/2 \end{aligned} \tag{5}$$

When the above-discussed circuit is integrated and the MOSFETs are formed on a wafer with an approximately 1-$\mu$m gate length and a several-$\mu$m gate width, the gate length is generally adjusted with high manufacturing precision. Manufacture dispersion of the gate width is extremely small as compared to that of the gate length, and it is assumed that the dispersion due to manufacture of the gate width is negligible.

Therefore, as discussed above, when the gate widths of the transistors M11 to M13 are set to be all the same, the dispersion due to manufacture of the gate width may be canceled for calculating the current transform ratio. Accordingly, in the above-discussed circuit, the gate length can be equivalently varied, and a desired current transform ratio may be precisely obtained. This improves flexibility of setting a forming area and a current value of the transistor.

Figure 6A:
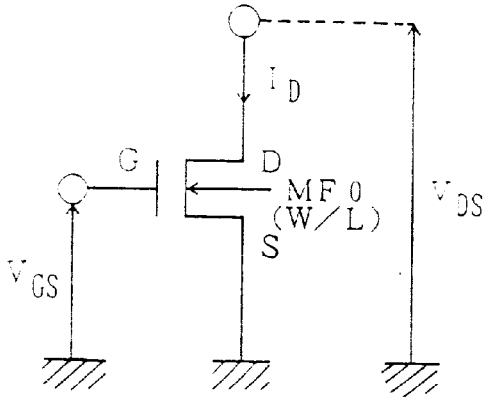
FIG. 6A and FIG. 6B show illustrations for explaining a principle of the transcurrent circuit shown in FIG. 5A.
Figure 6B:
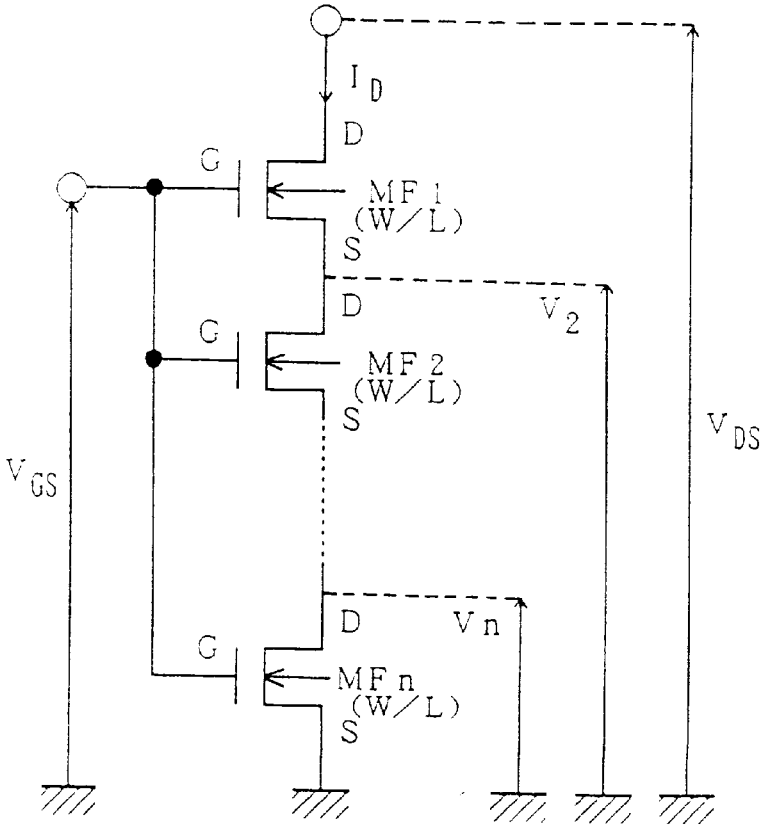

FIG. 6A and FIG. 6B show illustrations for explaining a principle of the transcurrent circuit shown in FIG. 5A. FIG. 6A shows a case where a single MOSFET is provided, and FIG. 6B shows a case where a plurality of MOSFETs connected in series are provided. The drain current $I_D$ of a MOSFET MF0 in a linear region ($(V_{GS}-V_{th})>V_{DS}$: $V_{th}$ is a threshold voltage) differs from that in a saturation region ($(V_{GS}-V_{th})\leqq V_{DS}$). Namely, in the linear region, the drain current $I_D$ is given by the following equation.

$$I_D=\beta_0(W/L)\times\{(V_{GS}-V_{th})V_{DS}-(1/2)V_{DS}^2\} \tag{6}$$

In the saturation region, the drain current $I_D$ is given by the following equation.

$$I_D=(1/2)\beta_0(W/L)\times(V_{GS}-V_{th})^2(1+\lambda V_{DS}) \tag{7}$$

In these equations, a symbol "W" indicates a gate width, a symbol "L" indicates a gate length, $\beta_0$ gate width, a symbol "p" indicates a carrier $\mu(\in_{OX}/t_{OX})$, a symbol "$\mu$" indicates a carrier mobility, a symbol "$\in_{OX}$" indicates a dielectric constant of a gate oxide film, a symbol "$t_{OX}$" indicates a thickness of the gate oxide film, and a symbol "$\lambda$" indicates a channel-length modulation-effect coefficient.

Since an approximation of $(1+\lambda V_{DS})\approx 1$ is conventionally given, in the saturation region, the drain current $I_D$ also may be transformed as follows:

$$I_D=(1/2)\beta_0(W/L)\times(V_{GS}-V_{th})^2 \tag{8}$$

In FIG. 6B, n MOSFETs discussed above are connected in series. In this case, for setting the condition $(V_{GS}-V_{th})\leqq V_{DS}$ in a general operational voltage range, only transistor MF1 is operative in the saturation region, and other transistors MF2 to MFn are operative in the linear region.

In a j-th transistor MFj ($2\leqq j\leqq n$), the drain current $I_{Dj}$ is given by equation (6) as follows:

$$\begin{aligned} I_{Dj} &= (1/2)\beta_0(W/L)\times\{2(V_{GS}-V_{j+1}-V_{th})(V_j-V_{j+1})-(V_j-V_{j+1})^2\} \\ &= (1/2)\beta_0(W/L)\times\{2(V_{GS}-V_{th})(V_j-V_{j+1})-V_j^2+V_{j+1}^2\} \end{aligned} \tag{9}$$

Therefore, a total drain current $I_D$ is given by the following equation.

$$\begin{aligned} \sum_{j=2}^{n} I_{Dj} &= (1/2)\beta_0(W/L)\times\left\{2(V_{GS}-V_{th})\sum_{j=2}^{n}(V_j-V_{j+1})-\sum_{j=2}^{n}(V_j^2-V_{j+1}^2)\right\} \\ &= (1/2)\beta_0(W/L)\times\{2(V_{GS}-V_{th})V_2-V_2^2\} \end{aligned} \tag{10}$$

From the above equation, the following equation is given.

$$(n-1)I_D=(1/2)\beta_0(W/L)\times\{2(V_{GS}-V_{th})V_2-V_2^2\} \tag{11}$$

Further, the drain current $I_D$ of the transistor MF1 is given by equation (7) as follows:

$$\begin{aligned} I_D &= (1/2)\beta_0(W/L)\times(V_{GS}-V_2-V_{th})^2(1+\lambda V_{DS}) \\ &= (1/2)\beta_0(W/L)\times\{(V_{GS}-V_{th})^2-2(V_{GS}-V_{th})V_2+V_2^2\}(1+\lambda V_{DS}) \end{aligned} \tag{12}$$

Substituting equation (11) for equation (12), the following equation is given.

$$I_D = (1/2)\beta_0(W/L)\times\{(V_{GS}-V_{th})^2(1+\lambda V_{DS})\}-(n-1)I_D(1+\lambda V_{DS}) \tag{13}$$

Further, when the approximation of $(1+\lambda V_{DS})\approx 1$ is provided, the drain current $I_D$ is obtained by the following equation.

$$I_D=(1/2)\beta_0(W/nL)(V_{GS}-V_{th})^2 \tag{14}$$

Namely, from equation (14), the whole transistors MF1 to MFn shown in FIG. 6B may be considered to be a single transistor having a gate length nL and a gate width W which is operative in the saturation region. Therefore, the transcurrent circuit 31 shown in FIG. 5A can be considered to be the circuit shown in FIG. 5B.

Next, a description will be given of a transcurrent operation, by referring to FIG. 5B. In this case, the gate width of the transistor (M12, M13) in the output stage is set to be $W_2$ (=$W_1$), and the gate length thereof is set to be $L_2$ (=2 $L_1$). Further, for example, the transistors M11 to M13 are respectively formed by an enhancement-type MOSFET (threshold voltage $V_{th}>0$).

In this configuration, when an input current $I_{D1}$ is provided into the drain (D) of the transistor M11, an output current $I_{D2}$ flows into the drain (D) of the transistor M12. In the transistor M11, since a condition $V_{DS1}=V_{GS}$ is set, the transistor M11 is operating in the saturation region. Also, with respect to the transistor M12, the transistor M12 is designed so as to operate in the saturation region $V_{DS}\geqq(V_{GS}-V_{th})$ for operating as a current source.

Therefore, from equation (7), the drain current $I_{DS1}$ of the transistor M11 is given by the following equation.

$$I_{D1}=(1/2)\beta_1(W_1/L_1)\times(V_{GS}-V_{th1})^2(1+\lambda_1 V_{DS1}) \quad (15)$$

The d rain current $I_{DS2}$ is given by the following equation.

$$I_{D2}=(1/2)\beta_2(W_2/L_2)\times(V_{GS}-V_{th2})^2(1+\lambda_2 V_{DS2}) \quad (16)$$

Since the approximation of $(1+\lambda V_{DS})\approx 1$ is provided, the $V_{GS}$ of equations (15), (16) is represented as follows:

$$\begin{aligned} V_{GS} &= \sqrt{\{(2I_{D1}/\beta_1)\times(L_1/W_1)\}} + V_{th1} \\ &= \sqrt{\{(2I_{D2}/\beta_2)\times(L_2/W_2)\}} + V_{th2} \end{aligned} \quad (17)$$

As discussed previously, since the transistors M11 to M13 have the same gate length, in equation (17), $\beta_1$ is equal to $\beta_2$, and $V_{th1}$ is equal to $V_{th2}$, these parameters being determined in a manufacturing process. Therefore, from equation (17), the following equation is given.

$$2\,I_{D1}(L_1/W_1)=2\,I_{D2}(L_2/W_2)$$

The above equation is transformed into the following equation.

$$\begin{aligned} I_{D2}/I_{D1} &= (W_2/L_2)/(W_1/L_1) \\ &= (W_1/2L_2)/(W_1/L_1) \\ &= 1/2 \end{aligned} \quad (18)$$

In the prior art transistor circuit, when dispersion of the gate length occurs, it causes dispersion of the threshold voltage $V_{th}$, and equation (18) can not be obtained from equation (17). Therefore, a desired current transform ratio may not be obtained.

Figure 7A:
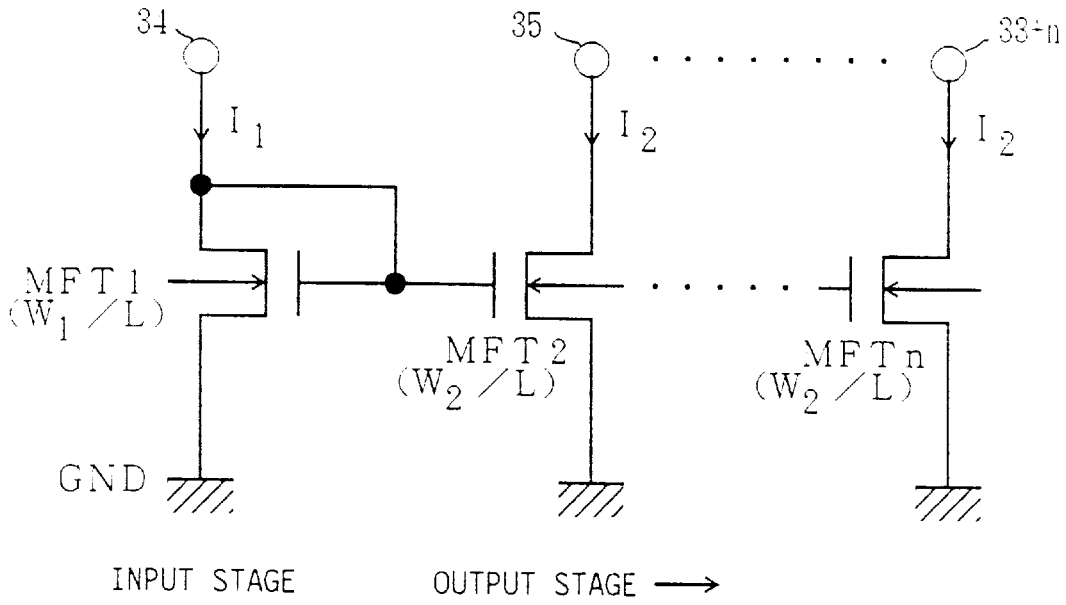
FIG. 7A PRIOR ART
FIG. 7A and FIG. 7B show illustrations for analyzing a transistor forming area of the transistors shown in FIG. 5A.
Figure 7B:
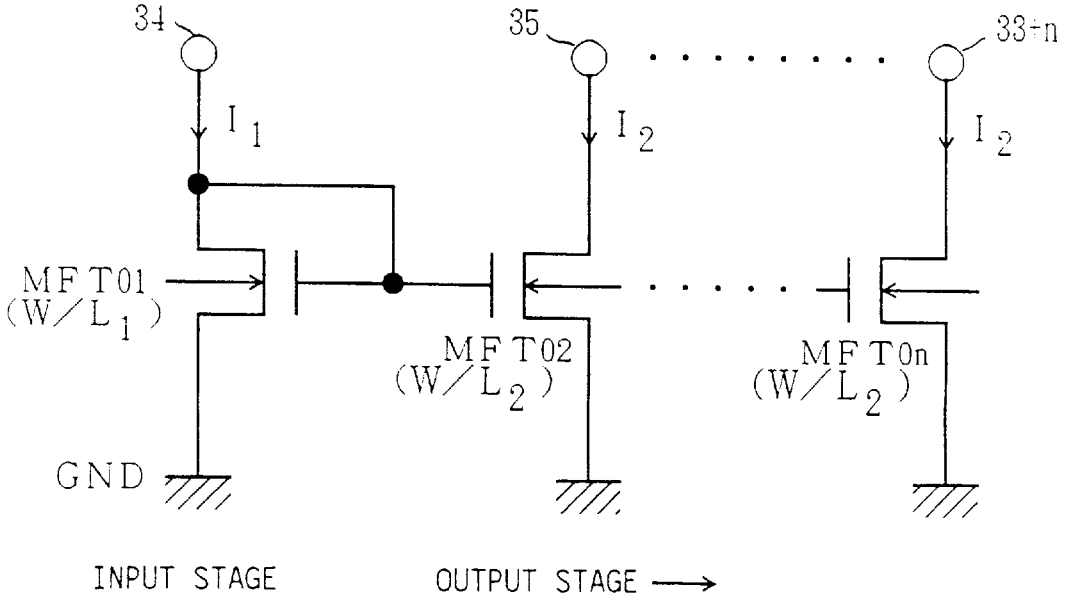

Next, a description will be given of a transistor forming area. FIG. 7A and FIG. 7B show illustrations for analyzing the transistor forming area of the transistors shown in FIG. 5A. FIG. 7A shows a prior art circuit example in which a plurality of transistors have the same gate length, and the current transform ratio is determined by the gate widths of the transistors. FIG. 7B shows a circuit example according to the present invention corresponding to the circuit shown in FIG. 5A.

FIG. 7A and FIG. 7B show typical application circuits to which a transcurrent circuit is applied, each application circuit having one input and multiple (n) outputs. In these application circuits, for power sources in the output stage, in addition to the second power source GND, a third power source 35 to a (33+n)th power source 33+n (n≧3) is used.

In order to prevent dispersion of the threshold voltage, in FIG. 7A, all gate lengths of transistors MFT01 to MFT0n are set to be the same value L, and all gate widths of the transistors MFT02 to MFT0n in the output stage are set to be the same value $W_2$ (a gate width of the transistor MFT01 in the input stage is set to be $W_1$). In FIG. 7B, all gate widths of transistors MFT01 to MFT0n are set to be the same value W, and all gate length of the transistors MFT02 to MFT0n in the output stage are set to be the same value $L_2$ (a gate length of the transistor MFT01 in the input stage is set to be $L_1$).

In the above-discussed configuration, an overall forming area $S_1$ of the transistors MFT01 to MFT0n shown in FIG. 7A is given by the following equation.

$$S_1=W_1\times L+n\times W_2 33\ L=L(W_1+nW_2) \quad (19)$$

Further, an overall forming area $S_2$ of the transistors MFT01 to MFT0n shown in FIG. 7B is given by the following equation.

$$S_2=W\times L_1+n\times W\times L_2 W(L_1+nL_2) \quad (20)$$

In the following, for example, one case will be considered. In this case, the gate width W and the gate length L are set to be the available minimum values in the manufacturing process, and a ratio $I_2/I_1$=m is given.

In the circuit shown in FIG. 7A, in order to realize the minimum circuit area (gate area), relationships $W_1$=W and $W_2$=mW are required. In this case, a total gate area $S_1$ is given by the following equation.

$$S_1 L\times W\times(1+n\times m) \quad (21)$$

Further, in the circuit shown in FIG. 7B, in order to realize the minimum circuit area (gate area), relationships $L_1$=mL and $L_2$=L are required. In this case, a total gate area $S_2$ is given by the flowing equation.

$$S_2=L\times W\times(m+n) \quad (22)$$

Therefore, to reduce the circuit area in FIG. 7B as compared to that in FIG. 7A, a condition $(S_1/S_2)>1$ is required. Namely, to satisfy the following equation, $$(S_1/S_2)=(1+m\times n)/(m+n)>1 \quad (23)$$

equation (23) is transformed into the following equation, $$(1/n)+(m/n)\times(n-1)>1,$$

and, a condition m≧n≧2 needs to be satisfied.

In FIG. 7A, each output circuit in the output stage is constructed with a single transistor (one of the transistors MFT02 to MFT0n) whose current transform ratio is determined by the same gate length L and the gate width $W_2$. Namely, the prior art transcurrent circuit shown in FIG. 7A corresponds to a circuit constructed by multiplying the output circuit having a single transistor shown in FIG. 1.

On the other hand, the transcurrent circuit shown in FIG. 7B is constructed by multiplying the output circuit shown in FIG. 5B, which is the equivalent circuit of the circuit having the two transistors shown in FIG. 5A.

In other words, in both the input stages of the circuits shown in FIG. 7A and FIG. 7B, each input circuit is constructed with a single transistor. However, in the output stage of the circuit shown in FIG. 7A, each output circuit is constructed with a single transistor. On the other hand, in the output stage of the circuit shown in FIG. 7B, each output circuit is constructed with a plurality of transistors.

However, as discussed above, under the given conditions, the gate area of the circuit shown in FIG. 7B may be reduced as compared to the circuit shown in FIG. 7A, and, thus, miniaturization of the transcurrent circuit according to the present invention may be achieved.

Further, when the transistors are connected in series in FIG. 7B, one of the drain (D) and source (S) layout patterns provided in a middle part of the two transistors can be omitted by reducing a gate interval of the two transistors. In this case, a total area of the transcurrent circuit may be substantially the same as a total area of gate areas of transistors having an equivalent single gate length.

Figure 8A:
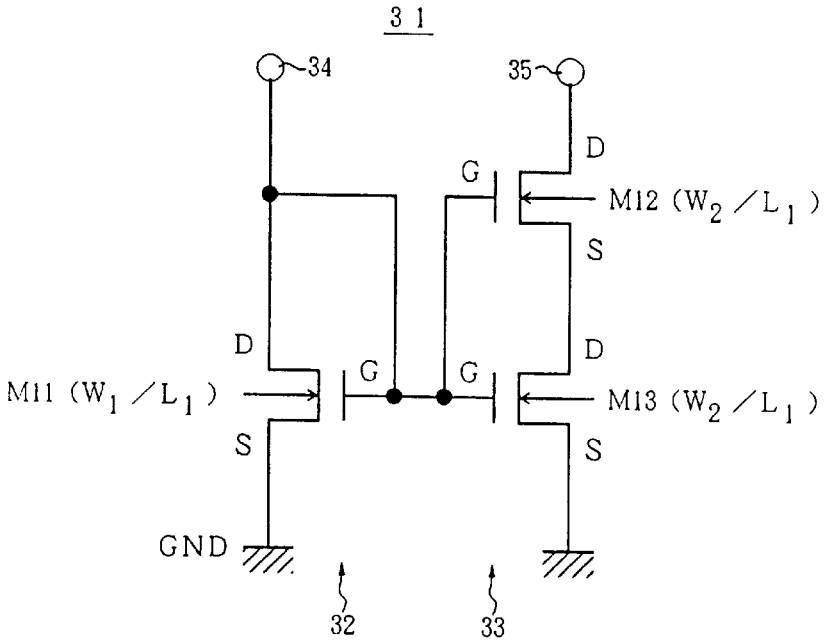
FIG. 8A shows a first modification of the transcurrent circuit shown in FIG. 5A.
Figure 8B:
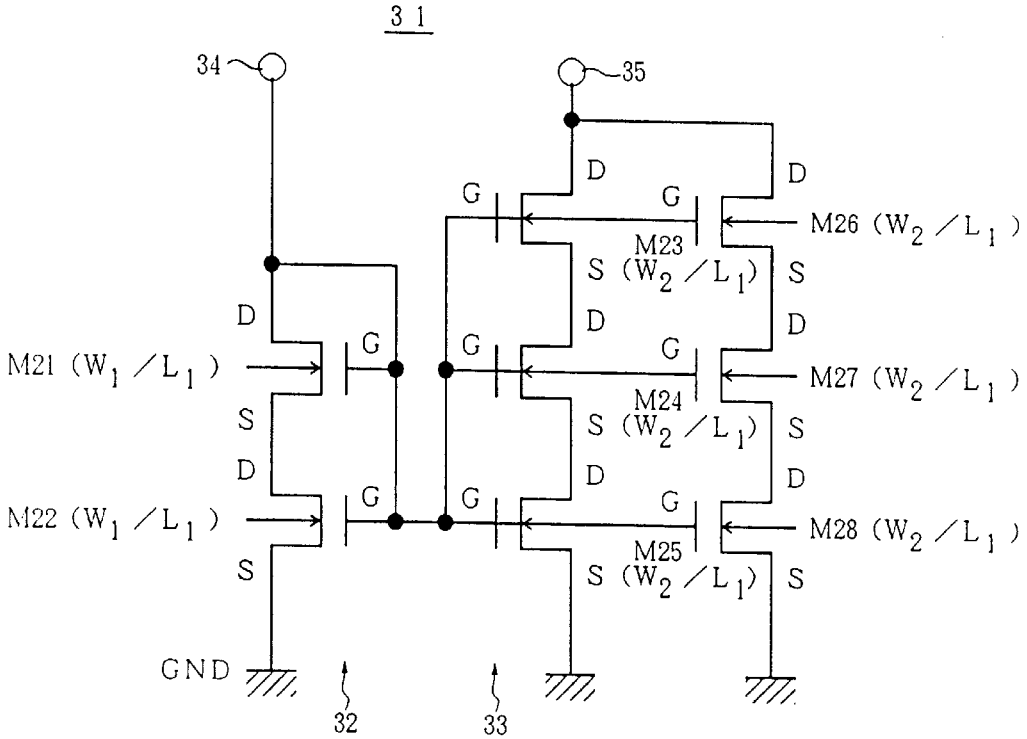
FIG. 8B shows a second modification of the transcurrent circuit shown in FIG. 5A.

Next, descriptions will be given of modifications of the transcurrent circuit shown in FIG. 5A, by referring to FIG. 8A and FIG. 8B. FIG. 8A shows a first modification of the transcurrent circuit shown in FIG. 5A, and FIG. 8B shows a second modification of the transcurrent circuit shown in FIG. 5A.

The transcurrent circuit 31 shown in FIG. 8A has substantially the same circuit configuration as that shown in FIG. 5A. However, in the transcurrent circuit 31 shown in FIG. 8A, different from the gate width $W_1$ of the transistor M11 constituting the input stage 32, the gate width $W_2$ of the transistors M12, M13 is formed constituting the output stage 33. The same gate length L1 is provided in all transistors M11 to M13.

In the transcurrent circuit 31 shown in FIG. 8A, as discussed previously, it is considered that the gate widths $W_1$ and $W_2$ of the transistors M11 to M13 are precisely formed. Therefore, a current transform ratio R3 in the transcurrent circuit 31 shown in FIG. 8A is represented by equation (5) as follows:

$$\begin{aligned} R3 &= \{\text{gate width of the transistor } M12(M13)/(\text{gate length of the transistor } M12 + \text{gate length of the transistor } M13)\} \times (\text{gate length of the transistor } M11/\text{gate width of the transistor } M11) \\ &= W_2/(2\times W_1) \end{aligned}$$

For example, when a ratio of the drain currents flowing the input stage 32 and the output stage 33 is set to be $mI_D:(I_D/n)$ (n is the number of the series-connected transistors on the output stage), and when the gate width and the gate length of the transistor M11 on the input stage 32 are respectively set to be mW and L, equivalent gate width and gate length of the transistor on the output stage 33 is given by gate width W and gate length nL (when a plurality of transistors are considered to be a single transistor). In this case, a total gate area $S_{02}$ is represented by $S_{02}=(m+n)\times W\times L$.

Figure 1:
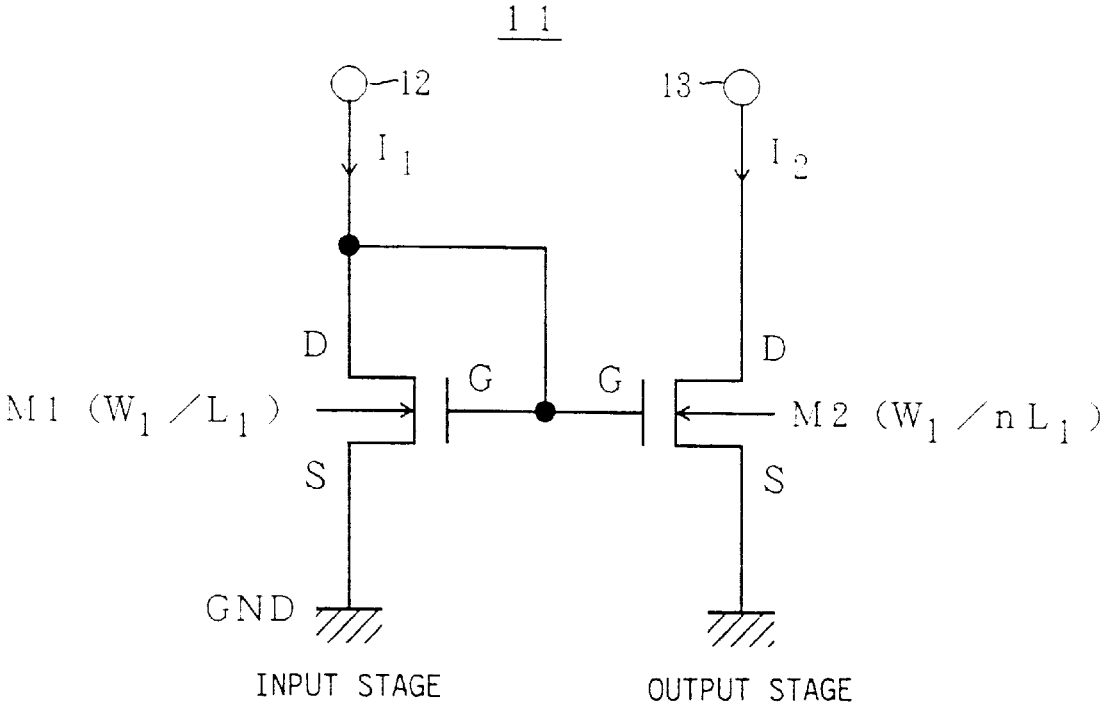
FIG. 1 PRIOR ART
FIG. 1 shows a schematic diagram of a prior art transcurrent circuit.

On the other hand, in the prior art circuit shown in FIG. 1, when the same gate width is provided in all transistors, and when the gate width and the gate length of the transistor on the input stage is respectively set to be mW and L in the above-discussed current ratio (in this case, a relationship $mnI_D:I_D=mI_D:(I_D/n)$ is provided), the gate width and the gate length of the transistor on the output stage is respectively given by W and L. In this case, a total gate area $S_{01}$ is represented by $S_{02}=(mn+1)\times W\times L$.

Therefore, when n and m are set so as to provide a condition $(S_{01}/S_{02})>1$, the gate forming area of the circuit shown in FIG. 8A may be reduced as compared to the circuit shown in FIG. 1. Namely, since a condition $n\geqq 2$ is already defined, when a condition $m\geqq n$ is provided, the gate forming area of the circuit according to the present invention may be reduced.

In the transcurrent circuit 31 shown in FIG. 8A, in the same way as the circuit shown in FIG. 5A, the input stage 32 is constructed with the single transistor M11, and the output stage 33 is constructed with a plurality of transistors M12, M13. However, the present invention is not limited to the above-discussed configuration. Namely, the input stage 32 may be constructed with a plurality of transistors, and the output stage 33 may be constructed with a single transistor. Also, in this configuration, the same effects may be obtained by using the same gate length.

In the transcurrent circuit 31 shown in FIG. 8B, on the input stage 32, a plurality of transistors M21, M22 (N-channel MOSFETs) are connected in series between the first power source 34 and the second power source GND. Respective gates (G) of the transistors M21, M22 are connected to a drain (D) of the transistor M21. The same gate width $W_1$ and the same gate length $L_1$ is provided in the transistors M21, M22.

In the output stage 33 in FIG. 8B, between the third power source 35 and the second power source GND, a plurality of transistors M23 to M25 (N-channel MOSFETs) are connected in series, and a plurality of transistors M26 to M28 (N-channel MOSFETs) are connected in series. Respective gates (G) of the transistors M23 to M28 are connected to the gates (G) of the transistors M21, M22 on the input stage 32. In this case, the same gate width $W_2$ and the same gate length $L_1$ are provided in the transistors M23 to M28 constituting the output stage 33.

Therefore, for all transistors M21 to M28 constituting the transcurrent circuit 31, the same gate length $L_1$ is set. However, the same gate width is provided in each of the input stage 32 and the output stage 33, and the gate width on the input stage 32 is formed different from the gate width on the output stage 33.

In such a configuration, a current transform ratio R4 of the transcurrent circuit 31 shown in FIG. 8B is given by the following equation from equation (5).

$$R4=(2\times W_2/3\times L_1)\times(2\times L_1/W_1)=4\times W_2/(3\times W_1)$$

As discussed above, in the transcurrent circuit 31 according to the present invention, at least one of the input stage 32 and the output stage 33 is constructed with a plurality of transistors, and at least the same gate length is set in all the transistors. In such a configuration, flexibility of setting a current value based on the transistor area and the current transform ratio toward the output stage 33 may be improved.

Therefore, when the current source is used, the current value may be reduced to at least sufficient value, and a circuit area in the integrated circuit may be reduced. Accordingly, miniaturization and power reduction of an overall integrated circuit may be achieved.

In the above-discussed transcurrent circuits, the N-channel MOSFETs are used for the transistors. However, the present invention is not limited to the above configuration, but P-channel MOSFETs are also usable for the transistors in the transcurrent circuit according to the present invention. In this case, current polarity is inverted.

Figure 9:
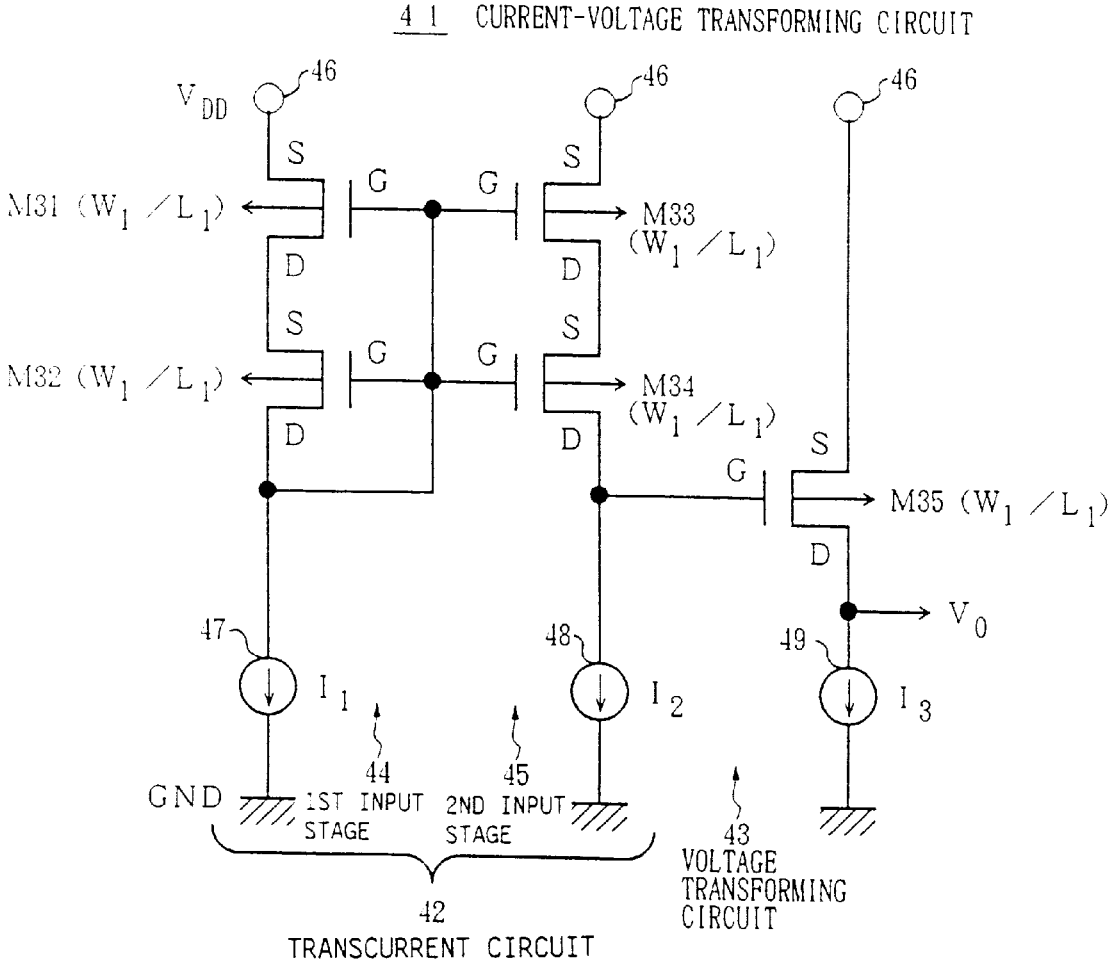
FIG. 9 shows a schematic diagram of a current-voltage transforming circuit according to a second embodiment of the present invention.

Next, a description will be given of a current-voltage transforming circuit according to a second embodiment of the present invention. FIG. 9 shows a schematic diagram of the current-voltage transforming circuit according to the second embodiment of the present invention. A current-voltage transforming circuit 41 shown in FIG. 9 is constructed with a transcurrent circuit 42 and a voltage transforming circuit 43.

The transcurrent circuit 42 is constructed with a first input stage 44 and a second input stage 45. On the first input stage 44, two transistors M31, M32 (P-channel MOSFETs) and a current source 47 are connected in series between a first power source ($V_{DD}$) 46 and the second power source GND.

Further, On the first input stage 44, a source (S) of the transistor M31 is connected to the first power source $V_{DD}$ 46, and a drain (D) thereof is connected to a source (S) of the transistor M32. A drain (D) of the transistor M32 is connected to the current source ($I_1$) 47. In addition, both gates of the transistors M31, M32 are connected to the drain (D) of the transistor M32.

On the second input stage 45 of the transcurrent circuit 42, two transistors M33, M34 (P-channel MOSFETs) and a current source 48 are connected in series between the first power source ($V_{DD}$) 46 and the second power source GND. Further, a source (S) of the transistor M33 is connected to the first power source $V_{DD}$ 46, and a drain (D) thereof is connected to a source (S) of the transistor M34. A drain (D) of the transistor M34 is connected to a current source ($I_2$) 48. In addition, both gates (G) of the transistors M33, M34 are connected to the gates (G) of the transistors M31, M32.

In the voltage transforming circuit 43, a transistor M35 (P-channel MOSFET) and a current source 49 are connected in series between the first power source ($V_{DD}$) 46 and the second power source GND. Further, a source (S) of the transistor M35 is connected to the first power source $V_{DD}$ 46, and a drain (D) thereof is connected to a current source ($I_3$) 49. In addition, a gate (G) of the transistor M35 is connected to the drain (D) of the transistor M34 on the second input stage 45 of the transcurrent circuit 42. An output voltage $V_0$ is produced from the drain of the transistor M35.

In all the transistors M31 to M35 constituting the current-voltage transforming circuit 41, the same gate width $W_1$ and the same gate length L are provided.

For example, in the current-voltage transforming circuit 41, when a ratio of current values $I_1$ to $I_3$ flowing the respective current sources 47 to 49 is set to be $I_1:I_2:I_3=1:1:2$, a current transform ratio R5 from the first input stage 44 of the transcurrent circuit 42 to the voltage transforming circuit 43 is given by the following equation.

$$\begin{aligned} R5 &= (\text{gate width of the transistor } M35 / \text{gate length of the transistor } M35) : \{\text{gate width of the transistor } M31(M32) / \times (\text{gate length of the transistor } M31 + \text{gate length of the transistor } M32)\} \\ &= I_3 : I_1 \end{aligned}$$

In the current-voltage transforming circuit 41, when the current $I_1$ flows on the first input stage 44 of the transcurrent circuit 42, the current $I_2$ ($=I_1$) also flows on the second input stage 45 thereof. At this time, a voltage of the drain (D) of the transistor M34 varies, and by this voltage variation being received in the gate (G) of the transistor M35, the current $I_3$ flows in the voltage transforming circuit 43. By the current $I_3$, the voltage amplitude $V_0$ is amplified, and is produced from the drain (D) of the transistor M35.

Figure 10A:
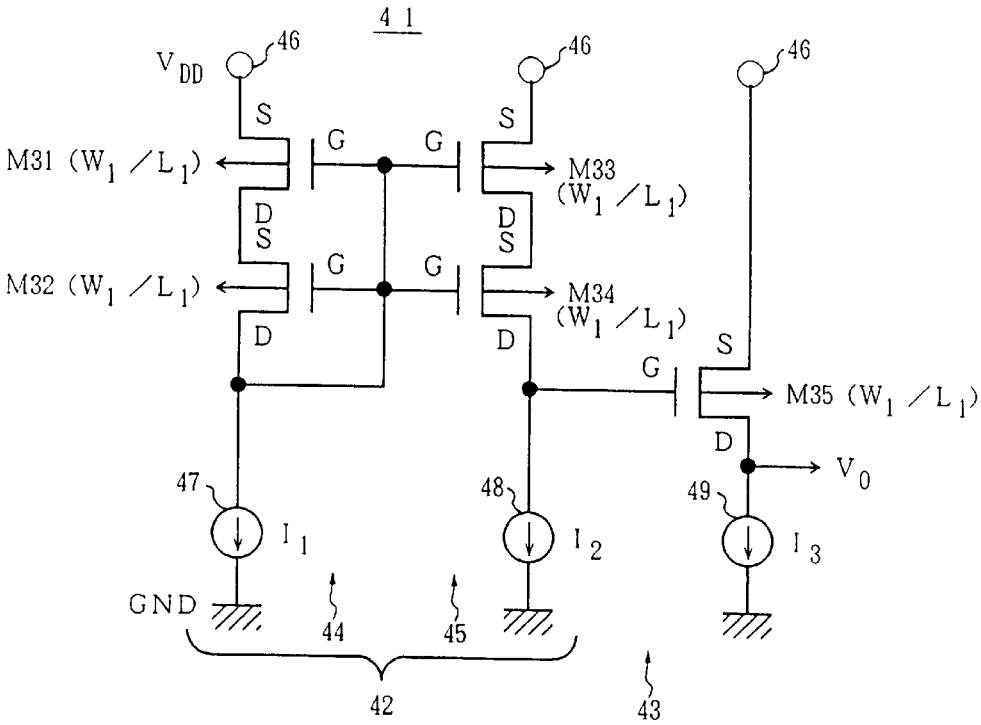
FIG. 10A shows a first modification of the current-voltage transforming circuit shown in FIG. 9.
Figure 10B:
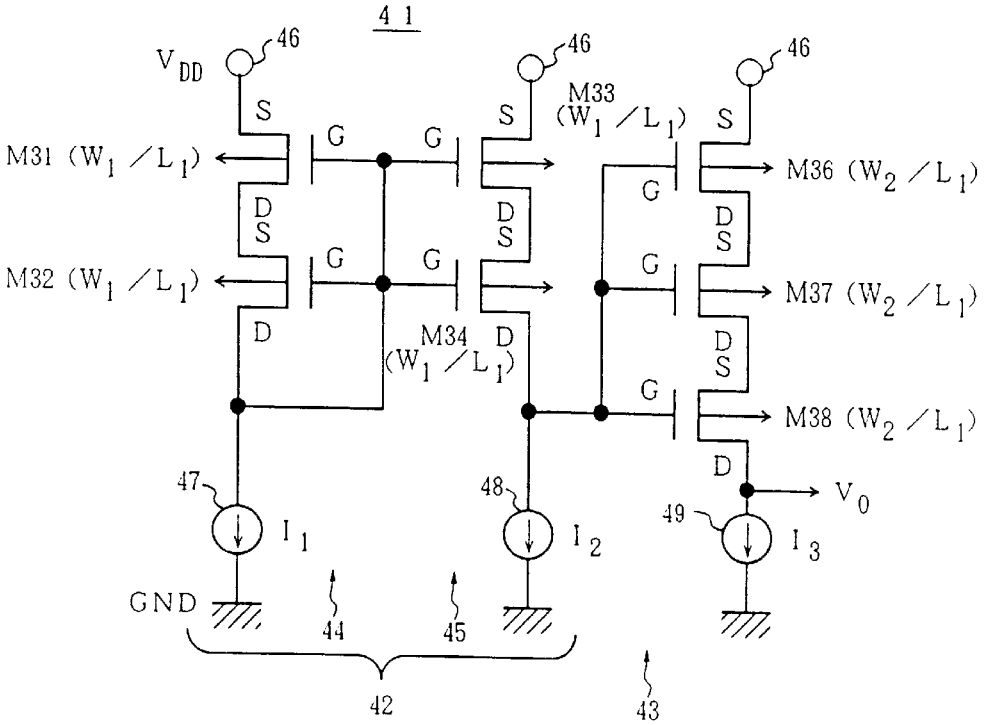
FIG. 10B shows a second modification of the current-voltage transforming circuit shown in FIG. 9.

Next, descriptions will be given of modifications of the current-voltage transforming circuit 41 shown in FIG. 9, by referring to FIG. 10A and FIG. 10B. FIG. 10A shows a first modification of the current-voltage transforming circuit 41 shown in FIG. 9, and FIG. 10B shows a second modification of the current-voltage transforming circuit 41 shown in FIG. 9.

The current-voltage transforming circuit 41 shown in FIG. 10A has substantially the same circuit configuration as that shown in FIG. 9. However, in the current-voltage transforming circuit 41 in FIG. 10A, the gate width $W_2$ is set to the transistor M35 of the voltage transforming circuit 43, different from the gate width $W_1$ of the other transistors M31 to M34. Namely, while the same gate length L1 is provided in all the transistors M31 to M35 constituting the current-voltage transforming circuit 41, the gate width $W_2$ of the transistor M35 is formed so as to be different from the gate width $W_1$ of the other transistors M31 to M34.

In the current-voltage transforming circuit 41 shown in FIG. 10A, as discussed previously, it is considered that dispersion due to manufacture of the gate widths of the transistors is extremely small, and may be negligible. Therefore, while the same gate length L1 is provided in all the transistors M31 to M35, the gate width $W_2$ of the transistor M35 may be flexibly changed according to a desired current transform ratio.

In the current-voltage transforming circuit 41 shown in FIG. 10A, a current transform ratio R6 is given by the following equation.

$$\begin{aligned} R6 &= I_3 / I_1 \\ &= (\text{gate width of the transistor } M35 / \text{gate length of the transistor } M35) \times \{(\text{gate length of the transistor } M31 + \text{gate length of the transistor } M32) / \text{width of the transistor } M31\ (M32)\} \\ &= 2W_2 / W_1 \end{aligned}$$

In the current-voltage transforming circuit 41 shown in FIG. 10B, the voltage transforming circuit 43 is constructed with three transistors M36 to M38 (P-channel MOSFETs) connected in series. The other circuit configuration is the same as that of the circuit shown in FIG. 10A.

A source (S) of the transistor M36 is connected to the first power source ($V_{DD}$) 46, and a drain (D) thereof is connected to a source (S) of the transistor M37. A drain (D) of the transistor M37 is connected to a source (S) of the transistor M38, and a drain (D) of the transistor M38 is connected to a current source 49. Further, respective gates (G) of the transistors M36 to M38 are connected to the drain (D) of the transistor M34.

In this case, while the same gate length L1 is provided in all the transistors M31 to M34, M36 to M38, the gate width $W_2$ is provided in the transistors M36 to M38, and is formed so as to be different from the gate width $W_1$ of the transistors M31 to M34.

In the current-voltage transforming circuit 41 shown in FIG. 10B, a current transform ratio R7 is given by the following equation.

$$\begin{aligned} R7 &= I_3 / I_1 \\ &= \{\text{gate width of the transistor } M36(M37, M38) / (\text{gate length of the transistor } M36 + \text{gate length of the transistor } M37 + \text{gate length of the transistor } M38)\} \times \{(\text{gate length of the transistor } M31 + \end{aligned}$$

-continued gate length of the transistor $M32$)/ width of the transistor $M31$ ($M32$)}

$= 2W_2/3W_1$

In this way, by the same gate length L1 being provided in all the transistors constituting the transcurrent circuit 42 and the voltage transforming circuit 43, flexibility of designing the transistor forming area and the current value may be improved. Therefore, the current value of the current source and the circuit area in the integrated circuit may be reduced. Accordingly, miniaturization and power reduction of the whole integrated circuit can be achieved.

In the above-discussed current-voltage transforming circuits, the P-channel MOSFETs are used for the transistors. However, the present invention is not limited to the above configuration, but N-channel MOSFETs are also usable for the transistors in the current-voltage transforming circuit according to the present invention. In this case, polarity with respect to the connecting with the current source needs to be inverted.

Further, the present invention is not limited to these embodiments, but other variations and modifications may be made without departing from the scope of the present invention.

What is claimed is:

1. A transcurrent circuit in which a first current flows in an output-stage circuit based on a second current flowing in an input-stage circuit and a given current transform ratio of said first current to said second current, wherein:

at least one of said input-stage circuit and said output-stage circuit in said transcurrent circuit is constructed with a plurality of transistors;

said plurality of transistors have the same gate length and are identical types; and said plurality of transistors have commonly-connected control nodes.

2. The transcurrent circuit as claimed in claim 1, wherein the number of said plurality of transistors is determined by said current transform ratio.

3. The transcurrent circuit as claimed in claim 1, wherein all the transistors in said input-stage circuit have the same gate width.

4. The transcurrent circuit as claimed in claim 1, wherein all the transistors in said output-stage circuit have the same gate width.

5. The transcurrent circuit as claimed in claim 1, wherein all the transistors in both of said input-stage circuit and said output-stage circuit have the same gate width.

6. The transcurrent circuit as claimed in claim 3, wherein said gate width of each transistor in said input-stage circuit is set so as to be different from a gate width of each transistor in said output-stage circuit according to said current transform ratio.

7. The transcurrent circuit as claimed in claim 4, wherein said gate width of each transistor in said output-stage circuit is set so as to be different from a gate width of each transistor in said input-stage circuit according to said current transform ratio.

8. A current-voltage transforming circuit comprising:

a transcurrent circuit in which a first current flows in an output-stage circuit based on a second current flowing in an input-stage circuit and a given current transform ratio of said first current to said second current, wherein at least one of said input-stage circuit and said output-stage circuit in said transcurrent circuit is constructed with a plurality of transistors, plurality of transistors have the same gate length and are identical types, and said plurality of transistors have commonly-connected control nodes; and a voltage transforming circuit producing a voltage according to said first current flowing the output-stage circuit of the transcurrent circuit, said voltage transforming circuit being constructed with a given number of transistors having the same gate length as that of the transistors in said transcurrent circuit.

9. The current-voltage transforming circuit as claimed in claim 8, wherein all the transistors in said voltage transforming circuit have the same gate width.

10. The current-voltage transforming circuit as claimed in claim 8, wherein all the transistors in said voltage transforming circuit have the same gate width as that of the transistors in at least one of said input-stage circuit and said output-stage circuit in said transcurrent circuit.

11. The current-voltage transforming circuit as claimed in claim 8, wherein all the transistors in said voltage transforming circuit have a gate width different from said gate width of the transistors in said input-stage circuit and said output-stage circuit of said transcurrent circuit.

12. The transcurrent circuit recited in claim 1, wherein all of said plurality of transistors are FETs.

13. The transcurrent circuit recited in claim 8, wherein all of said plurality of transistors are FETs.

14. The transcurrent circuit recited in claim 1, wherein each of said control nodes is a gate or a base of each of said plurality of transistors.

15. The transcurrent circuit recited in claim 1, wherein each of said control nodes is a gate or a base of each of said plurality of transistors.

* * * * *

UNITED STATES PATENT AND TRADEMARK OFFICE

CERTIFICATE OF CORRECTION

PATENT NO.: 5,982,206
DATED : November 9, 1999
INVENTOR(S): YUASA et al.

It is certified that error appears in the above-identified patent and that said Letters Patent is hereby corrected as shown below:

On the cover page:

Item [75], change "Yuasa Tachio;" to --Tachio Yuasa; --.

Column 16, line 48, change "1," to --8, --.

Signed and Sealed this

Sixth Day of February, 2001

*Attest:*

*Attesting Officer*

Q. TODD DICKINSON

*Director of Patents and Trademarks*